United States Patent [19]

Booty et al.

[11] 4,316,238

[45] Feb. 16, 1982

[54] LIGHT FIXTURE AND ELEVATOR THEREFOR

[75] Inventors: Donald A. Booty, Frankfort, Ill.; David Weisburg, Elkins Park, Pa.

[73] Assignee: Kidde Consumer Durables Corp., Bala Cynwyd, Pa.

[21] Appl. No.: 95,836

[22] Filed: Nov. 19, 1979

[51] Int. Cl.[3] ..... F21S 1/02

[52] U.S. Cl. ..... 362/147; 362/148; 362/149; 362/385; 362/384; 362/391; 362/402; 362/401; 362/404

[58] Field of Search ..... 362/147, 148, 149, 384, 362/385, 391, 401, 402, 404

[56] References Cited

U.S. PATENT DOCUMENTS 3,763,368 10/1973 Baggott ..... 362/401

3,911,267 10/1975 Kiehn ..... 362/401

*Primary Examiner*—Stephen J. Lechert, Jr.

*Attorney, Agent, or Firm*—Seidel, Gonda, Goldhammer & Panitch

[57] ABSTRACT

A frame attached to a ceiling supports a horizontally reciprocal carriage. A light fixture is supported by the carriage. A flexible conductor has one end connected to the fixture and an intermediate portion extending around a part of said carriage so that movement of the carriage in one direction lowers the fixture and movement in an opposite direction elevates the fixture.

14 Claims, 13 Drawing Figures

FIG. 5
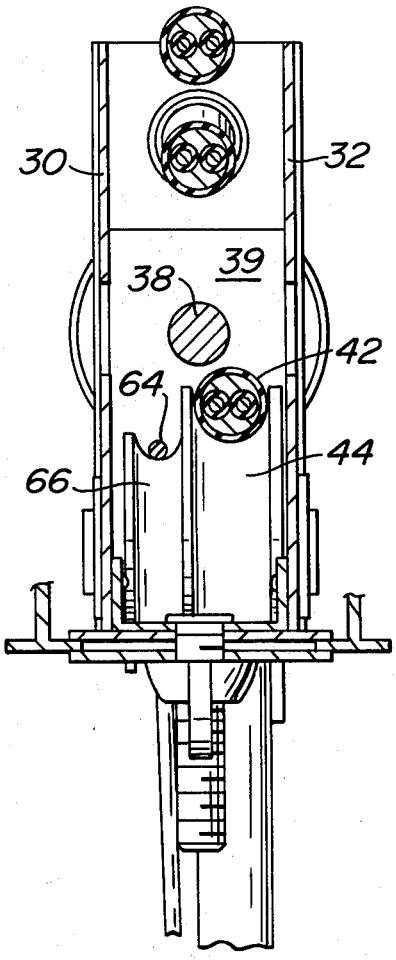
FIG. 6
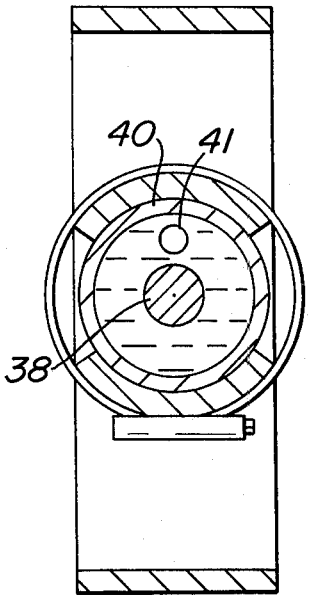
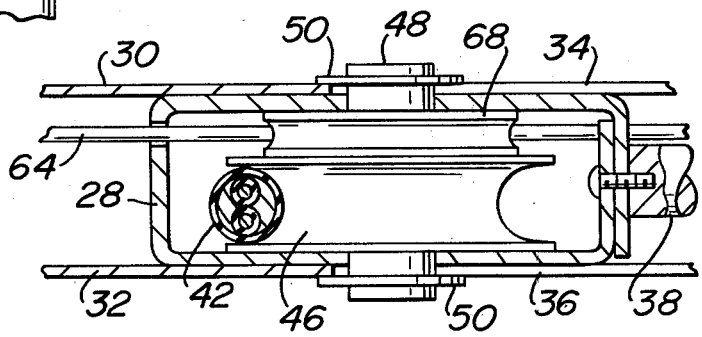
FIG. 7

FIG. 9
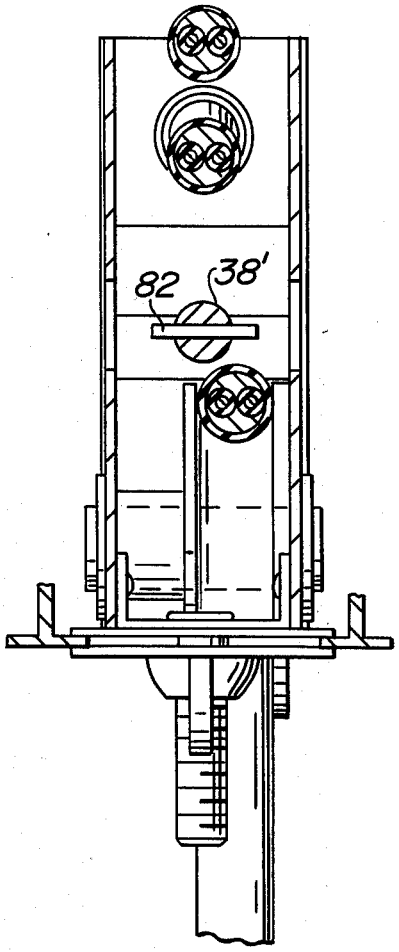
FIG. 13
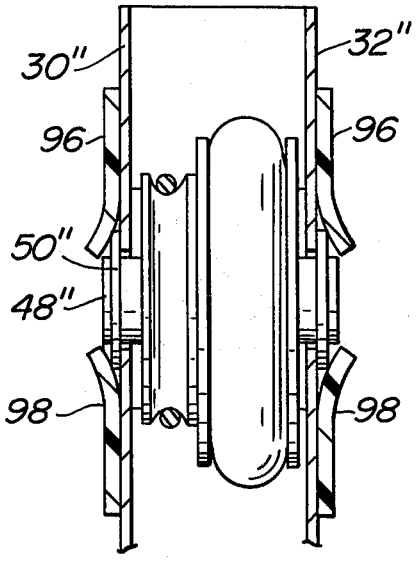
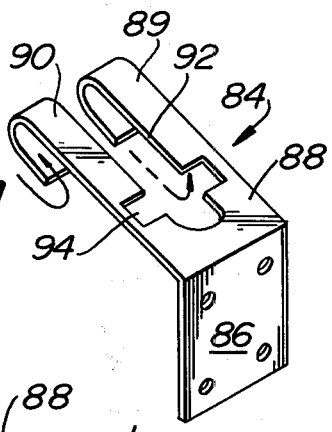
FIG. 11
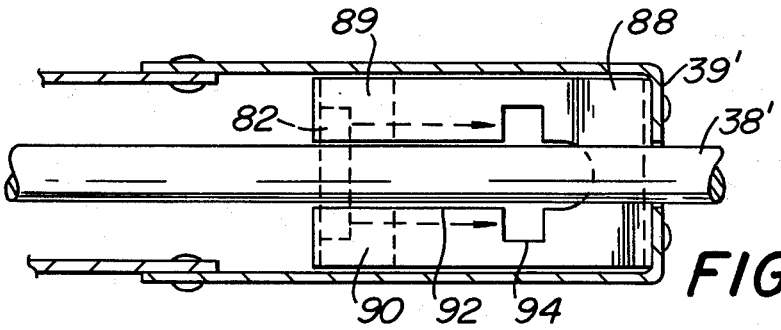
FIG. 10

LIGHT FIXTURE AND ELEVATOR THEREFOR

BACKGROUND

Light fixtures are displayed for sale by being suspended from a ceiling. Potential purchasers of such fixture obtain a distorted impression as to the fixture since they are looking upwardly at the suspended fixture. There is a need for a simple and reliable device for selectively lowering a fixture on display to an elevation corresponding generally to the elevation that the fixture will have when it is used in a home. The present invention is directed to a solution of that problem.

SUMMARY OF THE INVENTION

The present invention is directed to a lighting fixture and an elevator therefor. The invention includes a frame adapted to be attached to a ceiling and a horizontally reciprocal carriage supported by the frame. A light fixture is supported by the carriage by way of a flexible conductor. The flexible conductor has one end connected to the fixture and an intermediate portion extending around a part of the carriage so that movement of the carriage in one direction lowers the fixture and movement in an opposite direction elevates the fixture.

A preferred embodiment of the present invention includes a hydraulic cushioning means for controlling the rate of descent of the fixture with a constant tension spring for elevating the fixture at a uniform rate. The fixture is preferably provided with a control means for releasing the fixture so that it may descend when desired.

After studying the problem involved, it was concluded that the solution lies in providing a number of different elevators depending on the weight of the fixture. Thus, a suspended fixture that weighs 8 kilograms requires different controls than a fixture that weighs only 2 kilograms. While the preferred device can handle fixtures in the entire weight range of 1 to 15 kilograms, it is preferred to provide less expensive and less complicated embodiments for fixtures of lesser weight.

It is an object of the present invention to provide a novel lighting fixture elevator for controlling elevation and descent of lighting fixtures on display and supported from a ceiling.

Other objects will appear hereinafter.

For the purpose of illustrating the invention, there is shown in the drawings a form which is presently preferred; it being understood, however, that this invention is not limited to the precise arrangements and instrumentalities shown.

FIG. 5 is a sectional view taken along the line 5—5 in FIG. 2 but on an enlarged scale.

FIG. 6 is a sectional view taken along the line 6—6 in FIG. 2 but on an enlarged scale.

FIG. 7 is a sectional view taken along the line 7—7 in FIG. 2 but on an enlarged scale.

FIG. 9 is a sectional view taken along the line 9—9 in FIG. 8 but on an enlarged scale.

FIG. 10 is a sectional view taken along the line 10—10 in FIG. 8 but on an enlarged scale.

FIG. 11 is an enlarged perspective view of a spring clip shown in FIG. 8.

FIG. 13 is a sectional view taken along the line 13—13 in FIG. 12 but on an enlarged scale.

DETAILED DESCRIPTION

Figure 1:
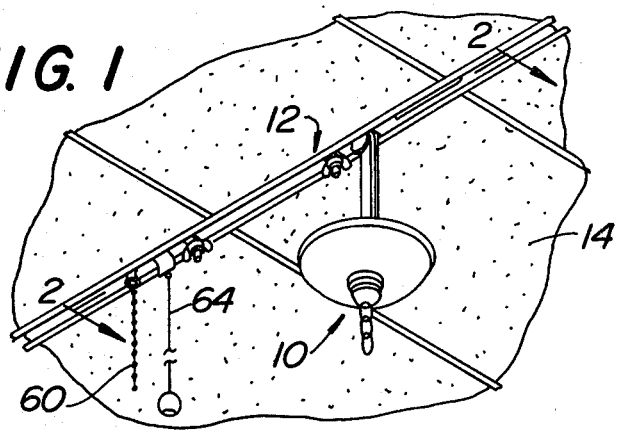
FIG. 1 is a partial perspective view of a ceiling from which a lighting fixture on display is supported.

Referring to the drawings in detail, wherein like numerals indicate like elements, there is shown in FIG. 1 an electrical light fixture 10 suspended by way of an elevator 12 from a ceiling 14. Assume fixture 10 weighs more than about 7 kilograms.

Figure 3:
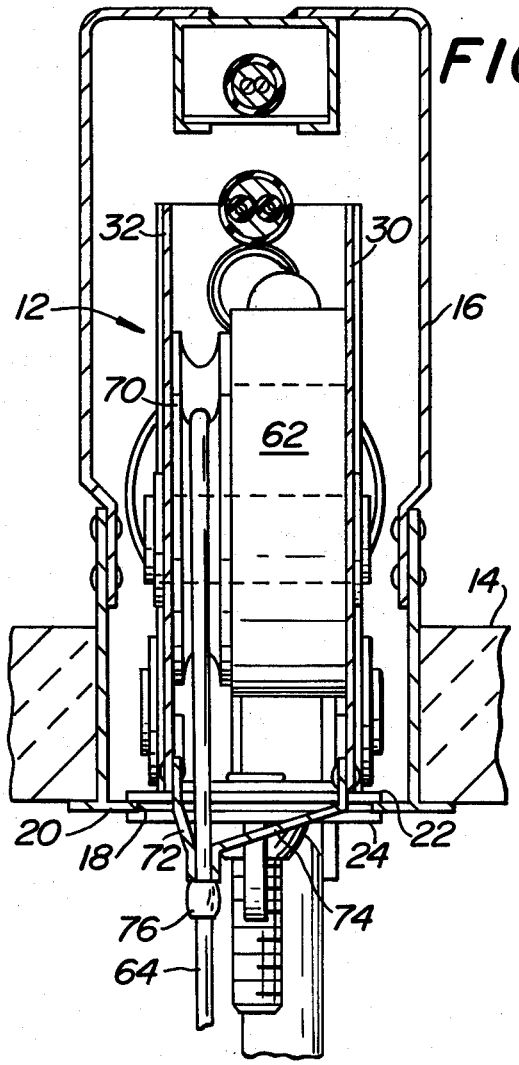
FIG. 3 is a sectional view taken along the line 3—3 in FIG. 2 but on an enlarged scale.

As shown more clearly in the lower portion of FIG. 3, the ceiling 14 has an elongated channel through which extends a generally channel-shaped frame 16 which is open at its bottom end. At the bottom end of the frame 16, there is provided inwardly extending flanges 20 which are spaced from one another so as to define a slot 18. A plurality of light fixtures and their associated elevators extend upwardly through the slot 18 in frame 12 at spaced points therealong for support by the frame 16.

Figure 2:
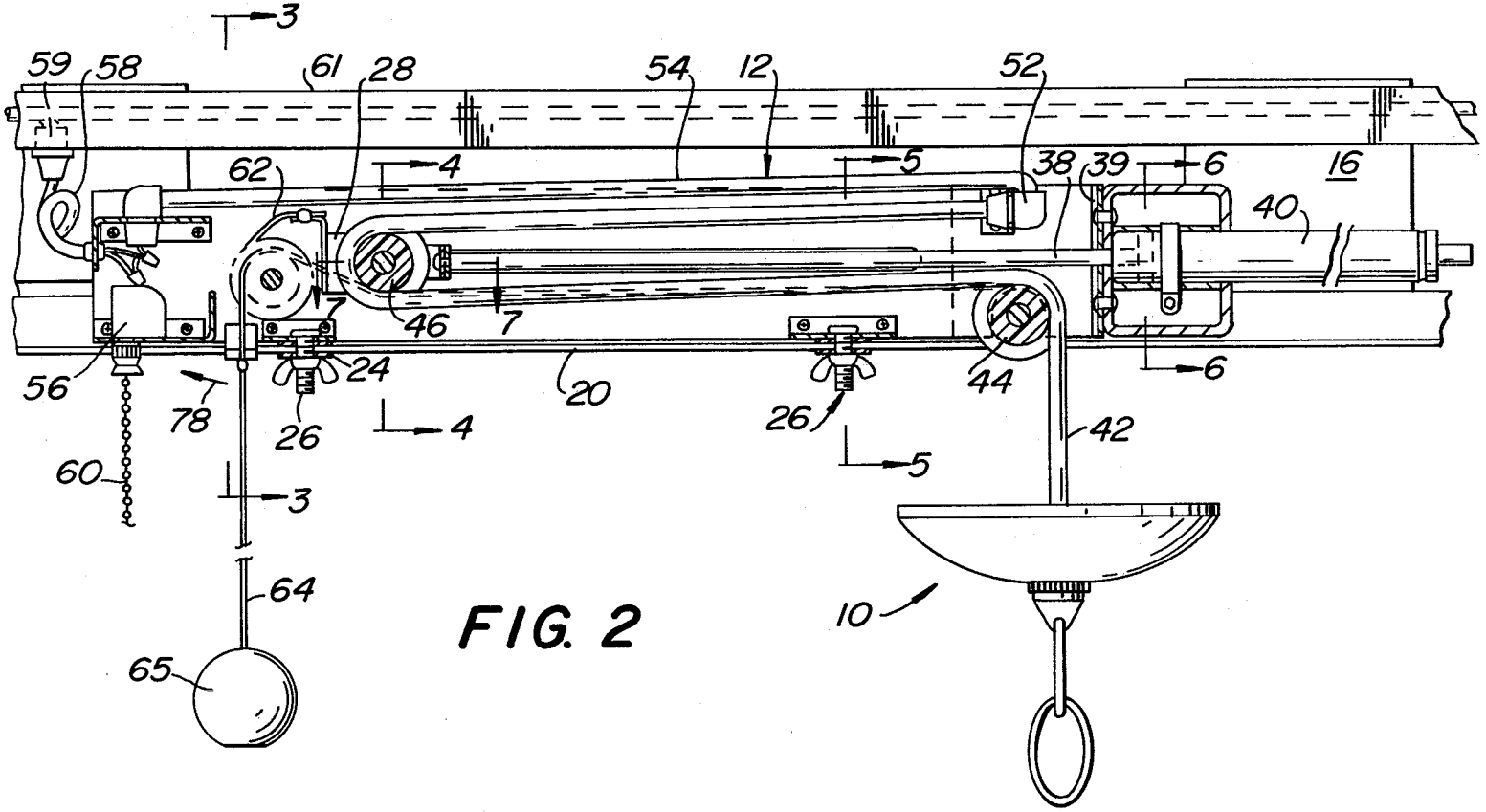
FIG. 2 is a sectional view taken along the line 2—2 in FIG. 1 but on an enlarged scale.

The elevator 12 is removably attached to the frame 16 in any convenient manner. For purposes of illustration, the elevator 12 includes a plurality of sets of swivel plates 22, 24 and an associated fastener 26. Referring to FIGS. 2 and 3, each of the plates 22 overlies the flanges 20 and each of the plates 24 is juxtaposed to the bottom surface of the flanges 20. When the wing nut is backed off, the plates 22, 24 may be swiveled to a position wherein they are freely movable through the slot 18. An advantage of this construction is that the wing nut need not be backed off totally but may be merely released whereby the entire elevator 12 may be slid longitudinally along the slot 18 with the wing nut then being subsequently tightened.

Figure 4:
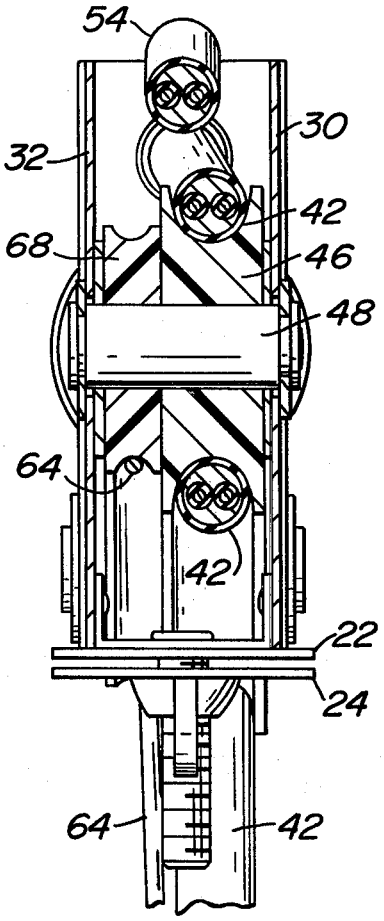
FIG. 4 is a sectional view taken along the line 4—4 in FIG. 2 but on an enlarged scale.

The elevator 12 includes a carriage 28 reciprocably supported by the side walls 30 and 32 of the elevator. Referring to FIGS. 4 and 7, the carriage 28 is guided by longitudinally extending slots 34 and 36 in the side walls 30 and 32 respectively and by a piston rod 38. The piston rod 38 extends longitudinally of the elevator and through a hole in the front wall 39. See FIG. 2. Piston rod 38 is connected to a piston within the hydraulic cylinder 40. The piston has a hole 41 therethrough as shown in FIG. 6 so that oil or some other hydraulic liquid may flow from one side of the piston to the other as the piston rod 38 is moved along its axis. Cylinder 40 acts like a dash pot.

The electric light fixture 10 is illuminated by way of electricity coupled thereto by way of the flexible conductor 42. Conductor 42 has one end secured to the light fixture. Intermediate portions of the flexible conductor 42 extend around a pulley sheave 44, and a pulley sheave 46 on the carriage 28. The other end of the flexible conductor 42 is connected to a connector 52. Connector 52 is connected by way of a rigid or flexible conductor to a switch 56 supported at one end of the elevator. The switch 56 is coupled by way of a conductor 58 to a plug-in receptacle 59 on a carrier 61 attached to the frame 16. The carrier 61 at spaced points therealong has similar plug-in receptacles so that a plurality of elevators may be electrically coupled thereto.

The shaft for the pulley 46 is designated 48 and extends through the slots 34, 36. Snap rings 50 are releasably attached to the ends of the shaft 48 and have dimensions greater than the width of the slots 34, 36.

The switch 56 is turned on and off by a pull chain 60 or the like. Thus, the light fixture 10 may be illuminated in various elevated positions. The carriage 28 is biased to the position shown in FIG. 2 by a constant tension spring 62. See FIGS. 2 and 3. Spring 62 is preferably of the type available from Vulcan Spring and Mfg. Co.

A flexible wire cable 64 or the like has a knob 65 connected to one end. The other end of cable 64 is connected to the lighting fixture 10. From the lighting fixture 10, the cable 64 extends upwardly and around the sheave 66 coaxial with sheave 44. Cable 64 extends rearwardly beneath a sheave 68 coaxial with sheave 46 and then partially around a sheave 70 which is coaxial with the spring 62. From sheave 70, the cable 64 extends downwardly through a latch.

The cable 64 is provided with a bead or projection 76 which is retained by the latch. See FIG. 3. The latch is defined by flexible spring metal members 72, 74. Members 72, 74 prevent the bead 76 from moving upwardly. The ball 65 is grasped manually and cable 64 is moved in the direction of arrow 78 until bead 66 clears the latch. Thereafter, the lighting fixture 10 will descend by itself under its own weight until the carriage 28 reaches the end of its travel. Descent of the lighting fixture 10 is controlled by the rate of hydraulic fluid flowing from one side of the piston to the other by way of the hole 41. In this manner, the lighting fixture 10 may be lowered to an elevation corresponding generally to the elevation at which the lighting fixture would be installed in a person's home or other building. This will enable the lighting fixture to be observed by a potential purchaser in the same conditions that it would be observed when installed.

While the fixture 10 descended, the spring 62 was unwound. When it is desired to elevate the fixture 10, the ball 64 is grasped and cable 64 is pulled downwardly. Such pulling force in combination with the spring 62 being wound will elevate the lighting fixture 10. As the bead 76 passes between the members 72, 74, the latter will spread apart and then snap closed to the position shown in FIG. 3. The lighting fixture 10 has now been elevated to the original position shown in FIG. 2.

The preferred embodiment of the present invention is shown in FIGS. 1–7 inclusive. It is designed primarily for use with heavy lighting fixtures weighing more than 7 kilograms but can be used with fixtures of lesser weight. While the fixture 10 is elevated by pulling on the cable 64, the spring 62 offsets some of the weight of the fixture as it is being elevated.

Figure 8:
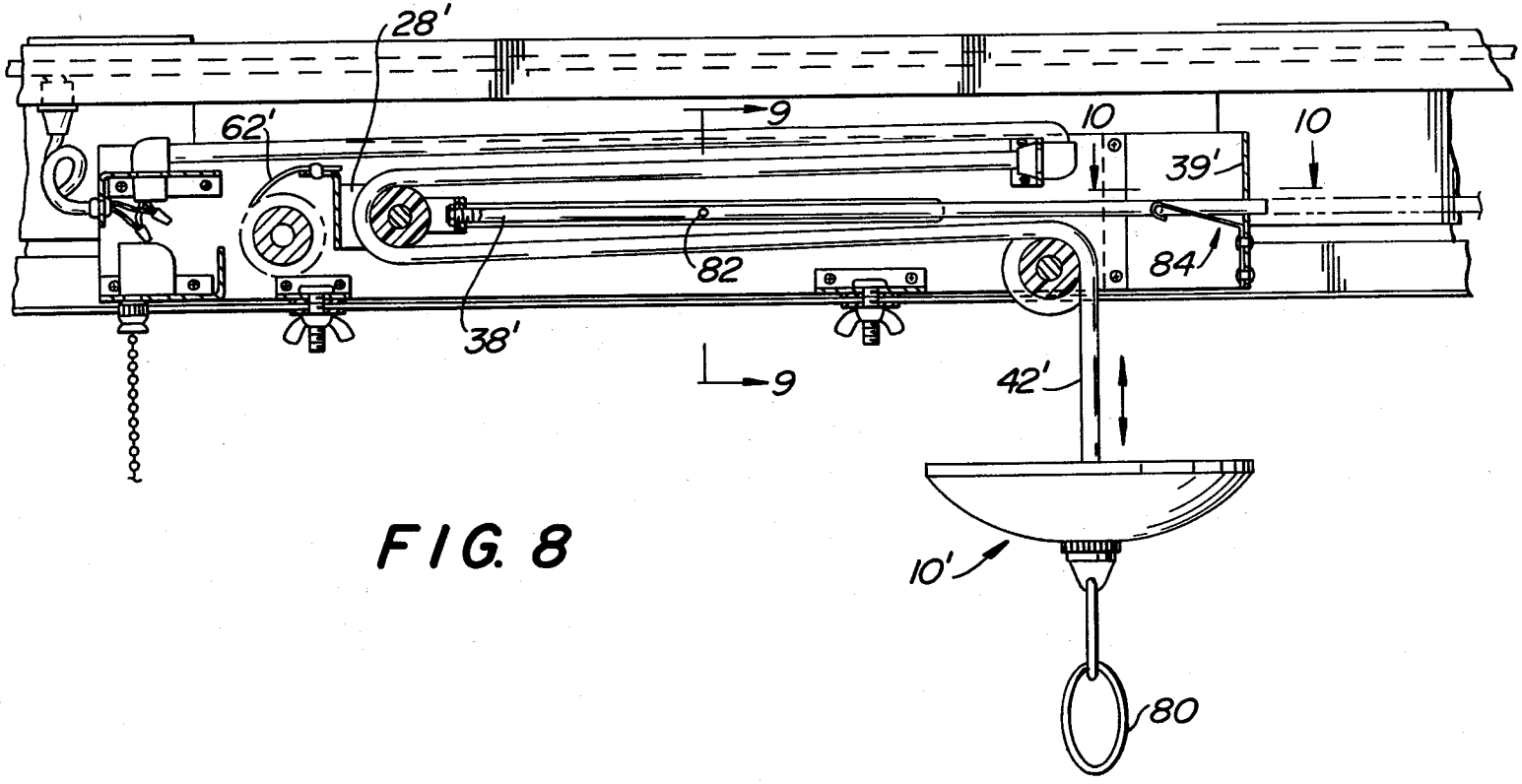
FIG. 8 is a view similar to FIG. 2 but showing another embodiment of the present invention.

In FIG. 8, there is illustrated another embodiment of the present invention for use primarily with light fixtures of a different weight range such as up to 3 kilograms. The embodiment of the present invention shown in FIG. 8 is identical with that described above except as will be made clear hereinafter. Hence, corresponding elements are identified by corresponding primed numerals. Further, corresponding structure is not described.

In FIG. 8, the lighting fixture 10' is shown in its elevated position and supports a ring 80 or comparable structure. To lower the fixture 10', the ring 80 is grasped and pulled downwardly. As the fixture 10' descends, the flexible conductor 42' moves the carriage 28' from left to right in FIG. 8. The piston rod 38' is guided by a hole in the front wall 39'. There is no cylinder 40 and no cable 64 in this embodiment.

A pin 82 extends transversely with respect to the piston rod 38'. See FIGS. 8 and 9. A retainer designated generally as 84 has a panel 86 fixedly secured to the end wall 39' in any convenient manner such as by fasteners or riveting. See FIG. 11. Retainer 84 includes a panel 88 which is bifurcated so as to define the legs 89 and 90 separated by a slot 92. Each of the legs 89 and 90 has a reverse bend so as to define a pocket therebelow. A transverse slot 94 intersects the slot 92.

As the fixture 10' descends, the pin 82 flexes the retainer 84 upwardly and then snaps into the pocket defined by the reverse bend on the legs 89, 90. The fixture may be elevated slightly so as to be certain that the pin 82 is in the pockets. Thereafter, the fixture will remain at the positioned elevation without being raised by the spring 62' since pin 82 will be held in the pockets of the retainer 84.

When it is desired to elevate the fixture 10', it is lowered for a short distance thereby causing the pin 82 to move through the slot 94 and slightly therebeyond in the right in FIG. 8. Thereafter, the fixture 10' may be let go. Spring 62' will elevate the fixture 10' to the position shown in FIG. 8. Pin 82 will ride on the upper surfaces of the legs 89 and 80 as it passes thereover and returns to the position as shown in FIG. 8.

Figure 12:
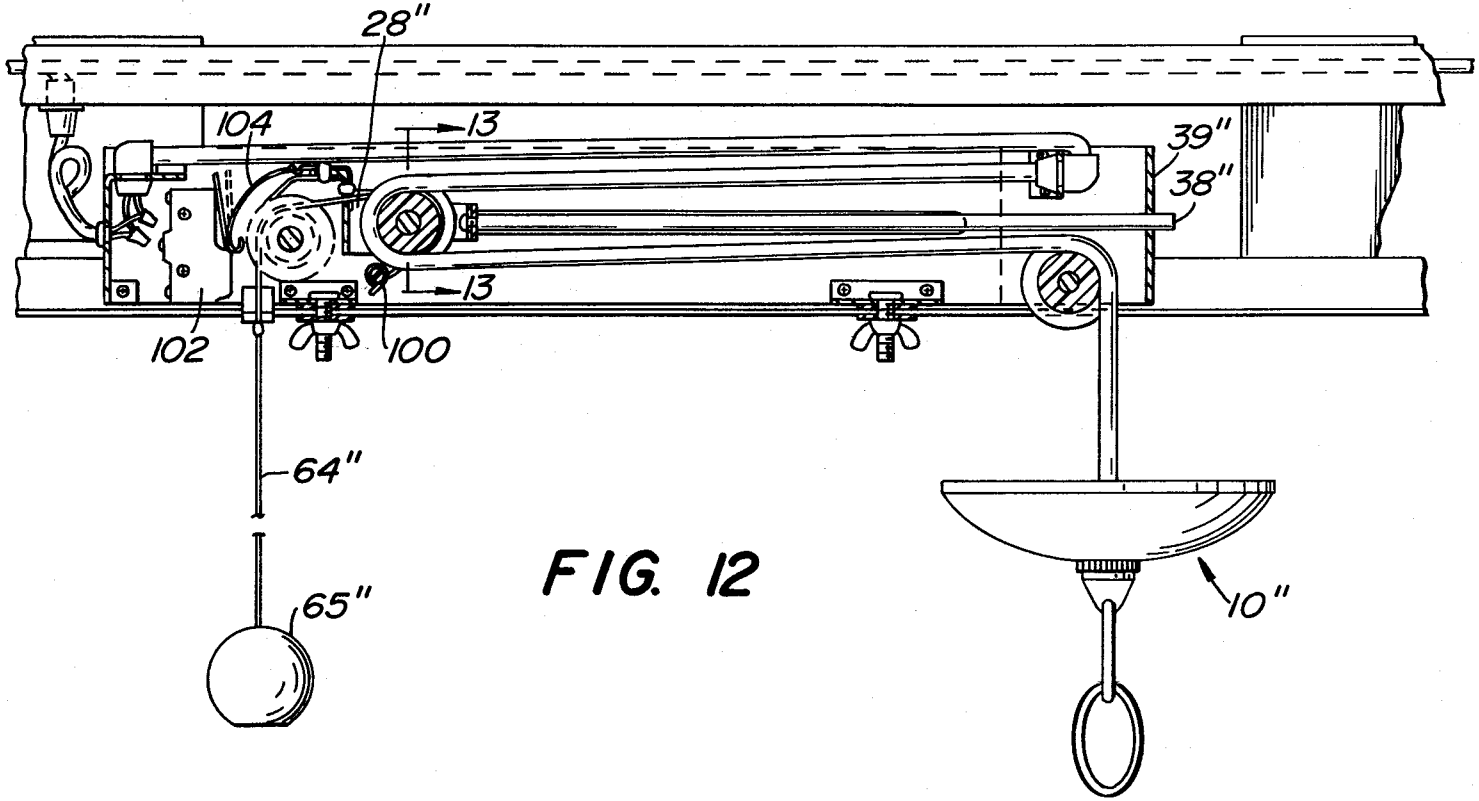
FIG. 12 is a view similar to FIGS. 2 and 8 but showing another embodiment of the present invention.

There is shown in FIGS. 12 and 13 another embodiment of the present invention which is identical with the embodiment shown in FIGS. 1–7 except as will be made clear hereinafter. Corresponding elements may be referred with corresponding double primed numerals and other corresponding structure need not be described.

In FIGS. 12 and 13, the carriage 28'' is guided by the piston rod 38'' which cooperates with a hole in the wall 39''. Also, the carriage 28'' is guided by the shaft 48'' which extends through slots in the side walls 30'' and 32''. In place of the hydraulic cylinder 40, there is provided a frictional checking arrangement to control the rate of descent of the fixture 10''.

Referring to FIG. 13, there is provided an upper plastic strip 96 on each side of the walls 30'', 32'' as well as a lower plastic strip 98. As the carriage 28'' reciprocates, the shaft 48'' and the snap ring 50'' flex the juxtaposed spaced apart edges of the strips 96, 98 outwardly to thereby provide a drag force on the descent of the fixture 10'. Fixture 10' is preferably in the weight range of 3 to 7 kilograms. In FIG. 12 the cable 64'' extends around the pulley on carriage 28'' and is then fixedly attached to a screw or lug 100 attached to the wall 30''. Hence, element 65'' moves up out of the way for a distance which is twice the distance of travel for the carriage 28''. A microswitch 102 turns on electricity to fixture 10'' as soon as the carriage 28'' starts to move. The microswitch 102 is controlled by a leaf spring actuator 104 which is curved at its free end and is attached at its other end to carriage 28''. When fixture 10'' reaches its uppermost position as shown in FIG. 12, actuator 104 automatically shuts off microswitch 102. Anyone of the above embodiments may have a microswitch for controlling the supply of electricity of the light fixture.

Thus, it will be seen that each of the embodiments of the present invention are designed for use with different weight fixtures while at the same time accomplishing the same result of facilitating observation of the fixture at the elevation which it would normally be used in a household. The elevation and descent of the fixture is accomplished in a simple and easy manner and requires minimum effort. Each of the embodiments may be juxtaposed to one of the other embodiments with each of the elevators being disposed end-to-end and releasably attached to the frame 16.

The present invention may be embodied in other specific forms without departing from the spirit or essential attributes thereof and, accordingly, reference should be made to the appended claims, rather than to the foregoing specification, as indicating the scope of the invention.

We claim:

1. Apparatus comprising a frame adapted to be attached to a ceiling, said frame supporting a light fixture elevator, said elevator including a horizontally reciprocal carriage, a light fixture supported by said carriage and being in an elevated position when the carriage is in a first position and being at a lower elevation when the carriage is in a second position, a flexible conductor having one end connected to said fixture and an intermediate portion extending around a part of said carriage so that movement of the carriage controls the elevation of the fixture, means biasing said carriage to said first position, and said elevator including means for guiding said carriage as it moves between said positions.

2. Apparatus in accordance with claim 1 wherein said frame is open on one side, said elevator extending through a slot in said one side of the frame, and means for releasably attaching said elevator to said frame when the frame is installed in a ceiling.

3. Apparatus in accordance with claim 1 wherein said biasing means applies a uniform biasing pressure at all times regardless of the elevation of the light fixture.

4. Apparatus in accordance with claim 1 wherein said guide means includes a horizontally disposed rod having one end attached to said carriage.

5. Apparatus in accordance with claim 1 including a flexible rope or cable having one end connected to the light fixture to facilitate elevating the light fixture, and a latch on the elevator for retaining the rope or cable in a restrained relationship when the light fixture is at its uppermost position.

6. Apparatus in accordance with claim 1 including a hydraulically operated dash pot connected to said carriage for controlling the rate of movement of the carriage, said dash pot being supported by said elevator.

7. Apparatus in accordance with claim 1 wherein said guide means includes horizontal slots in vertical walls of the elevator, said carriage including a shaft member extending through each of said slots and guided thereby.

8. Apparatus in accordance with claim 1 including a pin member movable with the carriage, a resilient flexible container supported by the elevator and cooperating with the pin member to restrain the carriage in said second position in opposition to said spring bias with the light fixture being in its lower elevation.

9. Apparatus for elevating and lowering a lighting fixture from a position adjacent the ceiling to an elevation where it may be readily observed in profile comprising a frame adapted to be attached to a ceiling, said frame having a longitudinally extending slot adapted to be flush with the ceiling, a light fixture elevator, said elevator being attached to said frame and being disposed within said slot, said elevator including at least one pulley sheave having a fixed axis and supported by the elevator adjacent one end thereof, said elevator including a horizontally reciprocal carriage, a light fixture, a flexible electrical conductor having one end connected to said fixture, said conductor extending upwardly over said first pulley sheave and around a pulley sheave on the carriage so that said light fixture moves upwardly or downwardly as said carriage moves horizontally, a switch electrically coupled to said light fixture by way of said conductor to facilitate illumination of the fixture in its lowermost position.

10. Apparatus in accordance with claim 9 including means on said elevator for controlling the rate of descent of said light fixture.

11. Apparatus in accordance with claim 10 including a flexible wire or cable having one end connected to said fixture and supported by said elevator in a manner to facilitate raising the light fixture by pulling downwardly on the rope or cable, and means on the elevator for cooperating with said rope or cable to restain the rope or cable when the light fixture is in its uppermost position.

12. Apparatus in accordance with claim 9 including means biasing said carriage to a position corresponding to the uppermost position of said light fixture.

13. Apparatus in accordance with claim 12 including means on said elevator to latch said carriage and oppose said spring bias when the light fixture is in its lowermost position.

14. Apparatus in accordance with claim 9 wherein said switch is triggered by movement of said carriage so that said fixture is illuminated at all times except when in its uppermost position at which time the switch is rendered inoperative by said carriage.

* * * * *